US010665217B2

(12) United States Patent
Ichiki

(10) Patent No.: US 10,665,217 B2
(45) Date of Patent: May 26, 2020

(54) PIVOT MECHANISM AND KEYBOARD APPARATUS

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/132,970

(22) Filed: Sep. 17, 2018

(65) Prior Publication Data

US 2019/0043463 A1 Feb. 7, 2019

Related U.S. Application Data

(63) Continuation of application No. PCT/JP2017/006252, filed on Feb. 21, 2017.

(30) Foreign Application Priority Data

Mar. 25, 2016 (JP) ..... 2016-061740

(51) Int. Cl.
*G10H 1/34* (2006.01)
*G10C 3/12* (2006.01)
*G10B 3/12* (2006.01)

(52) U.S. Cl.
CPC ..... *G10H 1/346* (2013.01); *G10B 3/12* (2013.01); *G10C 3/12* (2013.01); *G10H 1/34* (2013.01); *G10H 2220/285* (2013.01)

(58) Field of Classification Search
CPC ..... G10H 3/146; G10B 3/12; G10C 3/12
See application file for complete search history.

(56) References Cited

U.S. PATENT DOCUMENTS 3,913,187 A * 10/1975 Okuda ..... F16L 3/1075 24/484
4,840,334 A * 6/1989 Kikuchi ..... F16L 3/13 24/453
5,542,332 A * 8/1996 Tamai ..... G10H 1/344 84/251

(Continued)

FOREIGN PATENT DOCUMENTS

JP S57168304 U 10/1982
JP H0936563 A 2/1997

(Continued)

OTHER PUBLICATIONS

International Search Report issued in Intl. Appln No. PCT/JP2017/006252 dated May 9, 2017. English translation provided.

(Continued)

*Primary Examiner* — Robert W Horn
(74) *Attorney, Agent, or Firm* — Rossi, Kimms & McDowell LLP

(57) ABSTRACT

A pivot mechanism includes: a shaft portion; a bearing configured to contact the shaft portion at a first contact and a second contact and configured to pivot about a pivot axis relative to the shaft portion; and a supporter secured to the bearing, configured to contact the shaft portion at a third contact, and bendable in a direction different from a direction from the pivot axis toward the third contact.

14 Claims, 16 Drawing Sheets

(56) References Cited

U.S. PATENT DOCUMENTS 6,164,604 A * 12/2000 Cirino ..... F16L 3/04 248/74.3
6,241,198 B1 * 6/2001 Maruyama ..... F16L 3/223 248/49
6,290,201 B1 * 9/2001 Kanie ..... F16F 15/04 248/562
6,553,705 B2 * 4/2003 Geiberger ..... A47G 1/0611 40/647
6,915,990 B2 * 7/2005 Maruyama ..... F16B 21/071 248/62
7,036,775 B2 * 5/2006 Nakanishi ..... F16L 3/223 248/68.1
7,207,530 B2 * 4/2007 Ismert ..... F16L 3/13 248/67.7
7,219,931 B2 * 5/2007 Kato ..... B60R 16/0207 248/60
7,661,631 B2 * 2/2010 Ibaraki ..... F16L 3/1025 248/68.1
7,758,197 B2 * 7/2010 Choi ..... G02F 1/133604 362/219
7,802,762 B2 * 9/2010 Bauer ..... B60R 16/0215 24/555
7,896,296 B2 * 3/2011 Julian ..... F16L 3/127 248/547
8,882,059 B2 * 11/2014 Schmidt ..... F16L 3/1041 248/74.3
9,006,549 B2 * 4/2015 Suzuki ..... G10H 1/34 84/423 R
9,349,359 B2 * 5/2016 Takata ..... G10H 1/346
9,383,041 B2 * 7/2016 Kanie ..... F16L 3/13
9,495,940 B2 * 11/2016 Hoshino ..... G10C 3/18
9,607,587 B2 * 3/2017 Suzuki ..... G10H 1/34
9,672,797 B2 * 6/2017 Ohba ..... G10C 3/22
9,899,014 B2 * 2/2018 Nishimura ..... G10H 1/346
10,373,596 B2 * 8/2019 Suzuki ..... G10H 1/346
10,418,003 B2 * 9/2019 Taniguchi ..... G10C 3/12
2019/0035371 A1 * 1/2019 Ichiki ..... G10B 3/12
2019/0043459 A1 * 2/2019 Ichiki ..... G10C 3/12
2019/0043463 A1 * 2/2019 Ichiki ..... G10B 3/12
2019/0378486 A1 * 12/2019 Kamiya ..... G10H 1/346

FOREIGN PATENT DOCUMENTS

JP 2001265347 A 9/2001
JP 2002207484 A 7/2002
JP 2005119536 A 5/2005

OTHER PUBLICATIONS

Written Opinion issued in Intl. Appln. No. PCT/JP2017/006252 dated May 9, 2017. English translation provided.
International Preliminary Report on Patentability issued in Intl. Appln. No. PCT/JP2017/006252 dated Oct. 4, 2018. English translation provided.

* cited by examiner

900C

PIVOT MECHANISM AND KEYBOARD APPARATUS

CROSS REFERENCE TO RELATED APPLICATION

The present application is a continuation application of International Application No. PCT/JP2017/006252, filed on Feb. 21, 2017, which claims priority to Japanese Patent Application No. 2016-061740, filed on Mar. 25, 2016. The contents of these applications are incorporated herein by in their entirety.

BACKGROUND

The present disclosure relates to a pivot mechanism. The present disclosure also relates to a keyboard apparatus provided with the pivot mechanism.

A conventional acoustic piano such as a ground piano and an upright piano is constituted by many components. Assembling of these components is very complicated and accordingly requires a long time. In particular, an action mechanism provided corresponding to each key requires many components, resulting in very complicated assembling of these components.

To give a feeling (hereinafter referred to as "touch feeling") to a finger of a player through the key, the action mechanism includes a hammer provided with a weight under the key. The hammer pivots in response to pressing of the key so as to raise the weight provided on the hammer. For example, a bearing having a round opening is fitted onto a shaft portion, whereby the hammer disclosed in Patent Document 1 (Japanese Patent Application Publication No. 2002-207484) is mounted on a frame. In Patent Document 1, the width of an open end of the bearing is less than the diameter of the shaft portion, that is, the bearing is mounted on the shaft portion by what is called snap-fit.

SUMMARY

In a common snap-fit structure disclosed in Patent Document 1, the open end of the bearing holds the shaft portion. The bearing is bent in a normal direction at a contact between the bearing and the shaft portion near the open end. This open end is bent to attach and detach the shaft portion and the bearing. That is, when a strong external force is applied in a direction in which the shaft portion and the bearing are separated from each other, the shaft portion forces open the open end of the bearing, so that the bearing is separated from the shaft portion. In the case where bending of the open end of the bearing is made difficult to prevent separation of the bearing from the shaft portion, mounting of the bearing onto the shaft portion becomes difficult.

The object of the present disclosure is to achieve an improved pivot mechanism.

A pivot mechanism according to the present disclosure includes: a shaft portion; a bearing configured to contact the shaft portion at a first contact and a second contact and configured to pivot about a pivot axis relative to the shaft portion; and a supporter secured to the bearing, configured to contact the shaft portion at a third contact, and bendable in a direction different from a direction from the pivot axis toward the third contact.

A pivot mechanism according to the present disclosure includes: a shaft portion; a bearing configured to contact the shaft portion at a first contact and a second contact and configured to pivot about a pivot axis relative to the shaft portion; and a supporter secured to the bearing, configured to contact the shaft portion at a position on the pivot axis, and bendable in a direction away from at least one of the first contact and the second contact.

A keyboard apparatus according to the present disclosure includes: a key; a hammer assembly configured to pivot, in response to pressing of the key, about a pivot mechanism including (i) a shaft portion, (ii) a bearing configured to contact the shaft portion at a first contact and a second contact and configured to pivot about a pivot axis relative to the shaft portion, and (iii) a supporter secured to the bearing, configured to contact the shaft portion at a third contact, and bendable in a direction different from a direction from the pivot axis toward the third contact; a sensor disposed below the key and configured to detect an operation on the key; and a sound source section configured to produce a sound waveform signal in response to an output signal of the sensor.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
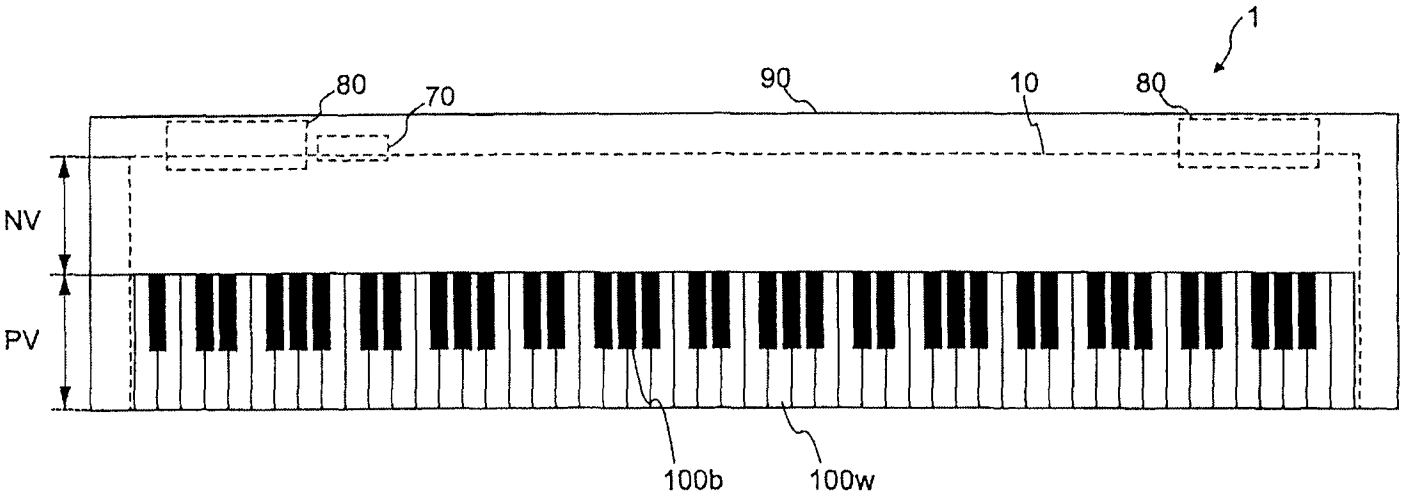
FIG. 1 is a view of a configuration of a keyboard apparatus in one embodiment of the present disclosure.

Hereinafter, there will be described embodiments of the present disclosure by reference to the drawings. It is to be understood that the following embodiments of the present disclosure are described by way of example, and the present disclosure should not be construed as limited to these embodiments. It is noted that the same or similar reference numerals (e.g., numbers with a character, such as A or B, appended thereto) may be used for components having the same or similar function in the following description and drawings, and an explanation of which may be dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes. In the following explanation, pivotal movement means relative movement. For example, pivotal movement of a component A with respect a component B means that the component B may pivot with respect to the fixed component A, that the component A may pivot with respect to the fixed component B conversely, and that the components A, B may pivot.

First Embodiment

Configuration of Keyboard Apparatus

FIG. 1 is a view of a configuration of a keyboard apparatus according to a first embodiment. In the present example, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b*. The white keys 100*w* and the black keys 100*b* are arranged side by side. The number of the keys 100 is N and 88 in this example. A direction in which the keys 100 are arranged will be referred to as "scale direction". The white key 100*w* and the black key 100*b* may be hereinafter collectively referred to "the key 100" in the case where there is no need of distinction between the white key 100*w* and the black key 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions respectively indicate directions in the case where the keyboard apparatus 1 is viewed from the player during playing. Thus, it is possible to express that the non-visible portion NV is located on a back side of the visible portion PV, for example. Also, directions may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
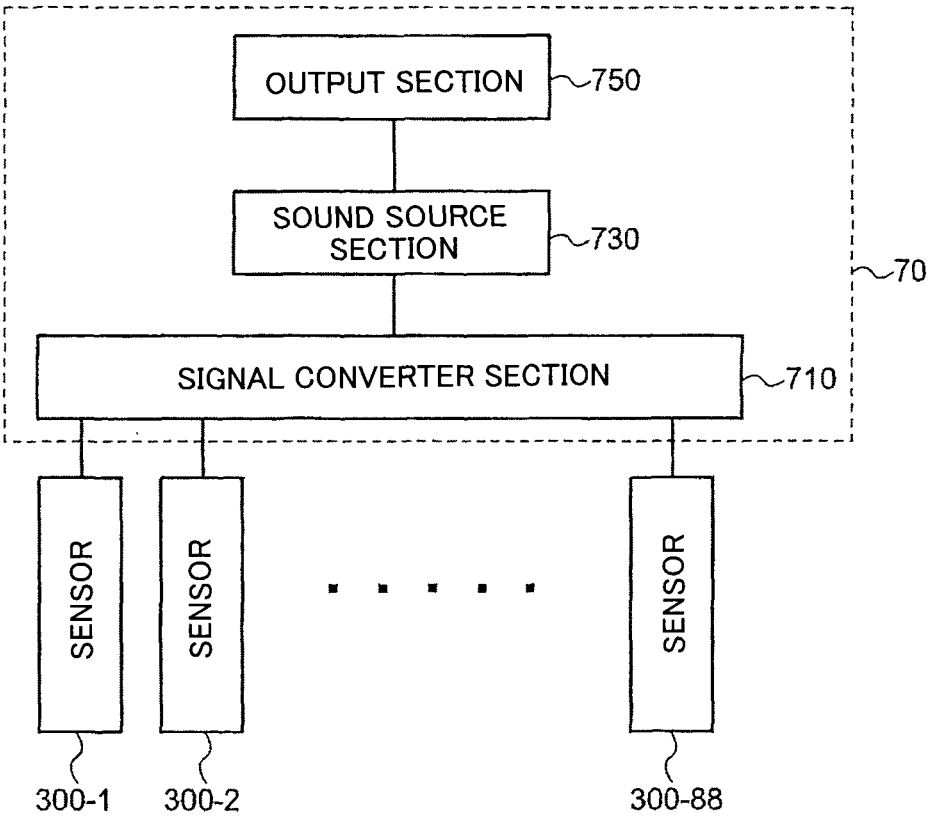
FIG. 2 is a block diagram illustrating a configuration of a sound source device in the one embodiment of the present disclosure.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
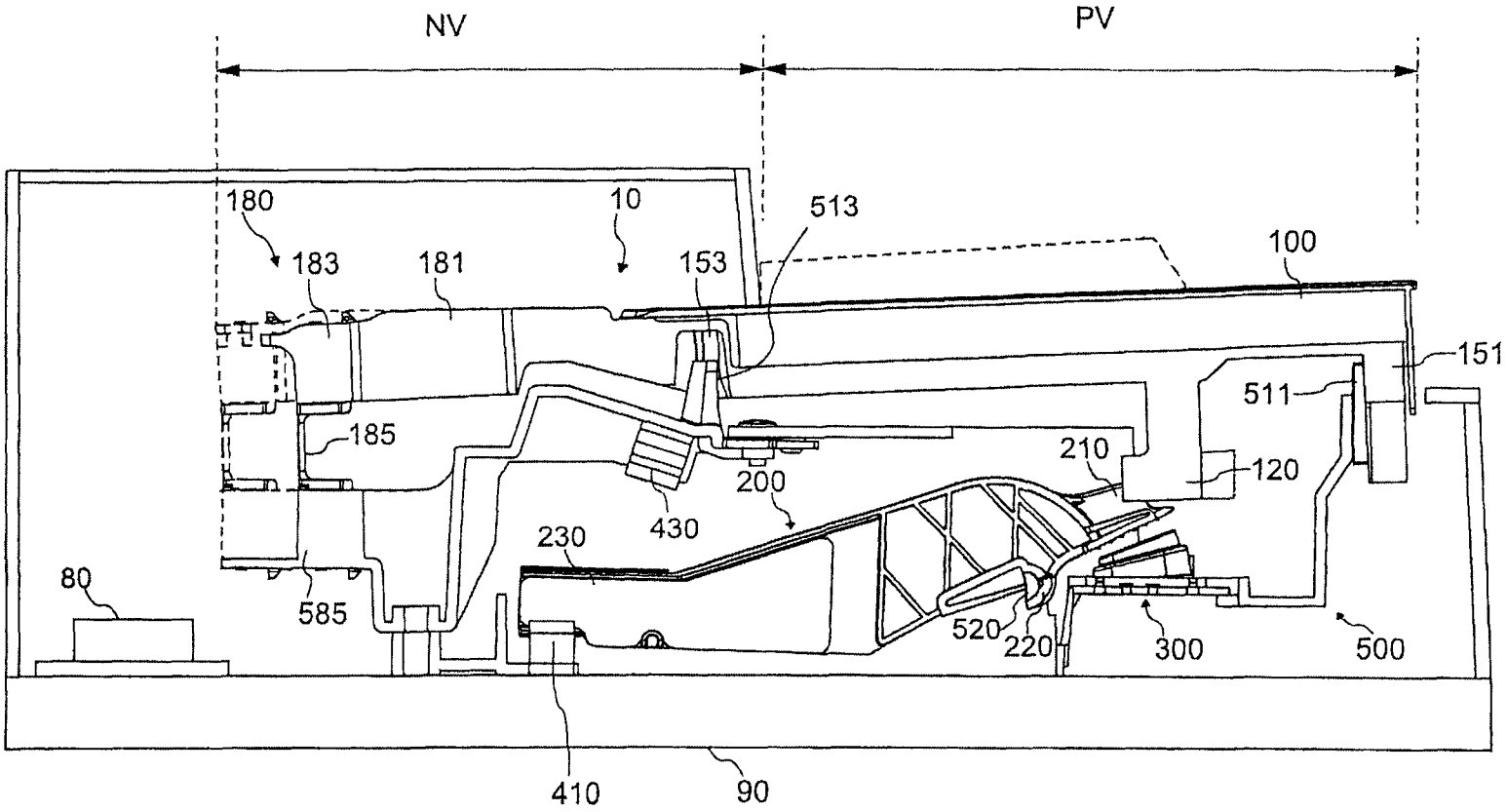
FIG. 3 is a view for explaining a configuration of the inside of a housing in the one embodiment of the present disclosure, with the configuration viewed from a lateral side of the housing.

FIG. 3 is a view of a configuration of the inside of the housing in the first embodiment, with the configuration viewed from a lateral side of the housing 90. As illustrated in FIG. 3, the keyboard assembly 10 and the speaker 80 are disposed in the housing 90. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV.

There will be next described a configuration of the keyboard assembly 10 with reference to FIG. 3. In addition to the keys 100, the keyboard assembly 10 includes a connecting portion 180, a hammer assembly 200, and the frame 500. The keyboard assembly 10 is formed of resin, and a most portion of the keyboard assembly 10 is manufactured by, e.g., injection molding. The frame 500 is fixed to the housing 90. The connecting portion 180 connects the keys 100 to the frame 500 such that the keys 100 are pivotable. The connecting portion 180 includes plate-like flexible members 181, key-side supporters 183, and rod-like flexible members 185. Each of the plate-like flexible members 181 extends from a rear end of a corresponding one of the keys 100. Each of the key-side supporters 183 extends from a rear end of a corresponding one of the plate-like flexible members 181. Each of the rod-like flexible members 185 is supported by a corresponding one of the key-side supporters 183 and a frame-side supporter 585 of the frame 500. That is, the rod-like flexible member 185 is disposed between the key 100 and the frame 500. The key 100 pivots with respect to the frame 500 by bending of the rod-like flexible member 185. The rod-like flexible member 185 is attachable to and detachable from the key-side supporter 183 and the frame-side supporter 585. It is noted that the rod-like flexible member 185 may be integral with the key-side supporter 183 and the frame-side supporter 585 or bonded thereto so as not to be attached or detached, for example.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present example, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

The hammer assembly 200 is attached so as to be pivotable with respect to the frame 500. A bearing 220 of the hammer assembly 200 and a shaft portion 520 of the frame 500 are in slidable contact with each other at at least three points. A front end portion 210 of the hammer assembly 200 is located in an inner space of a hammer supporter 120 of the key 100 and in contact with the hammer supporter 120 slidably substantially in the front and rear direction. This sliding portion, i.e., portions of the front end portion 210 and the hammer supporter 120 which are in contact with each other, are located under the key 100 at the visible portion PV (located in front of a rear end of the key main body portion). It is noted that a configuration of portions of the shaft portion 520 and the bearing 220 which are connected to each other, (a configuration of a pivot mechanism) will be described later in detail.

The hammer assembly 200 is provided with a metal weight 230 disposed on a back side of a pivot axis. In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. The hammer assembly 200 adds a weight to key pressing by the weight 230. The lower stopper 410 and the upper stopper 430 are formed of a cushioning material (such as a nonwoven fabric and a resilient material).

The sensor 300 is attached to the frame 500 under the hammer supporter 120 and the front end portion 210. When the key 100 is pressed, a lower surface of the front end portion 210 deforms the sensor 300, causing the sensor 300 to output detection signals. As described above, the sensors 300 are provided for the respective keys 100.

Configuration of Pivot Mechanism of Hammer Assembly

Figure 4A:
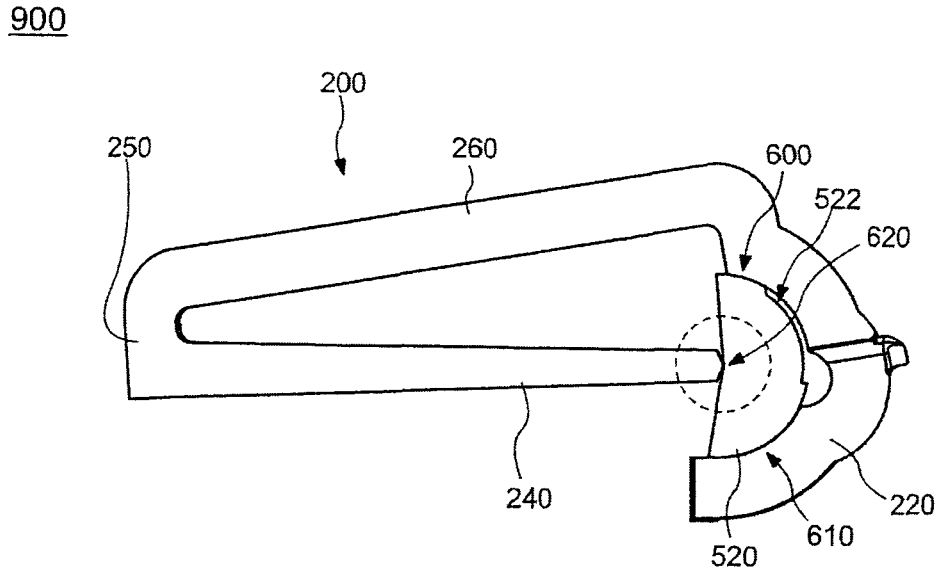
FIGS. 4A through 4C are enlarged views of a portion of a pivot mechanism of a hammer assembly according to one embodiment of the present disclosure.
Figure 4B:
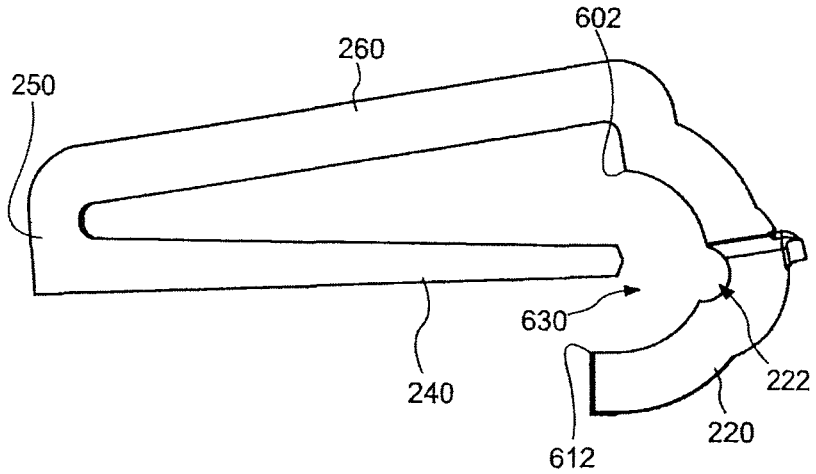
Figure 4C:
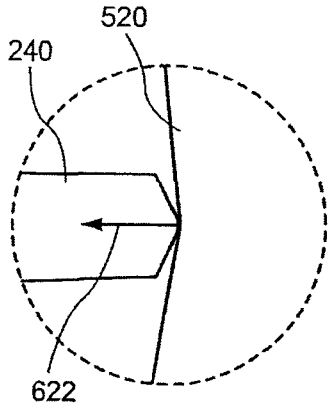

FIGS. 4A-4C are enlarged views of a portion of the pivot mechanism of the hammer assembly according to the one embodiment of the present disclosure. FIG. 4A is a view illustrating a state in which the bearing 220 is mounted on the shaft portion 520. FIG. 4(B) is an exploded view illustrating only the bearing 220. FIG. 4C is an enlarged view of an area indicated by the broken line in FIG. 4A. A configuration in which the hammer assembly 200 is connected to the shaft portion 520 will be described in detail with reference to FIGS. 4A-4C. For easier understanding purpose, an expression "the shaft portion 520 is attached to and detached from the hammer assembly 200 (the bearing 220)" may be used. The hammer assembly 200 includes the bearing 220, a supporter 240, a connecting portion 250, and a body 260. Here, a pivot mechanism 900 includes: the shaft portion 520 as a pivot axis of the hammer assembly 200; the bearing 220 for supporting the shaft portion 520; and the supporter 240. While a configuration in which the bearing 220 pivots with respect to the fixed shaft portion 520 will be described in the following explanation, the following embodiment may be applied to a configuration in which the shaft portion 520 pivots with respect to the fixed bearing 220.

The bearing 220 supports the shaft portion 520 at a first contact 600 and a second contact 610 and pivots about a pivot axis 620. In the present example, the pivot axis 620 is located in the shaft portion 520. The bearing 220 has an opening 630. The shaft portion 520 is held in a region inside the opening 630. It is noted that the first contact 600 and the second contact 610 are located on an inner surface of the bearing 220 in the opening 630. Here, the shaft portion 520 is in surface contact with the bearing 220. The first contact 600 and the second contact 610 are any given points on surfaces of the shaft portion 520 and the bearing 220 which are in contact with each other.

The width of each of open ends 602, 612 of the opening 630 is greater than or equal to the largest diameter of the shaft portion 520 that is the greatest among the diameters of the shaft portion 520. That is, the pivot mechanism 900 is configured such that the shaft portion 520 is not engaged with the bearing 220. A groove 222 is formed in the opening 630. A recess 522 is formed in an outer circumferential surface of the shaft portion 520. Each of the groove 222 and the recess 522 is usable as grease storage. Furthermore, the groove 222 and the recess 522 reduce the area of contact between the shaft portion 520 and the bearing 220, resulting in a reduced frictional force during pivotal movement of the shaft portion 520 and the bearing 220.

The supporter 240 is fixed to the bearing 220 via the connecting portion 250 and the body 260. The connecting portion 250 is provided on an opposite side of the body 260 from the bearing 220. The connecting portion 250 extends downward from the body 260. The supporter 240 is coupled to a lower end of the connecting portion 250 and extends from the connecting portion 250 toward the bearing 220. The supporter 240 supports the shaft portion 520 at a distal end of the supporter 240 (an end portion of the supporter 240 near the bearing 220). That is, the distal end of the supporter 240 is in contact with the shaft portion 520 in any of a situation in which the bearing 220 is pivoting with respect to the shaft portion 520 about the pivot axis and a situation in which the bearing 220 is not pivoting about the pivot axis. In FIGS. 4A-4C, a point at which the supporter 240 supports the shaft portion 520 substantially coincides with the pivot axis 620. It is noted that the distal end of the supporter 240 in FIGS. 4A-4C has a curved surface.

The supporter 240 has flexibility and is bent at least in a direction toward the body 260. In the present embodiment, the supporter 240 is bent in the direction toward the body 260 and in a direction away from the body 260. In other words, the supporter 240 is bent in a direction away from at least one of the first contact 600 and the second contact 610.

Here, the supporter 240 is configured such that an amount of bending of the supporter 240 is reduced in a direction in which the bearing 220 is separated from the shaft portion 520 (i.e., a direction directed from the shaft portion 520 toward the supporter 240). That is, the supporter 240 is configured such that an amount of bending of the supporter 240 is reduced in a direction 622 normal to a contact surface of the shaft portion 520 at a contact between the supporter 240 and the contact surface of the shaft portion 520.

The cross-sectional shape of each of the shaft portion 520 and the bearing 220 at the first contact 600 is an arc shape centered about a point on the pivot axis 620. Likewise, the cross-sectional shape of each of the shaft portion 520 and the bearing 220 at the second contact 610 is an arc shape centered about a point on the pivot axis 620. These shapes enable smooth pivotal movement of the bearing 220 with respect to the shaft portion 520. It is noted that each of the shape of each of the shaft portion 520 and the bearing 220 at the first contact 600 and the shape of each of the shaft portion 520 and the bearing 220 at the second contact 610 may not be an arc shape centered about a point on the pivot axis 620.

Method of Disassembling Pivot Mechanism of Hammer Assembly

Figure 5A:
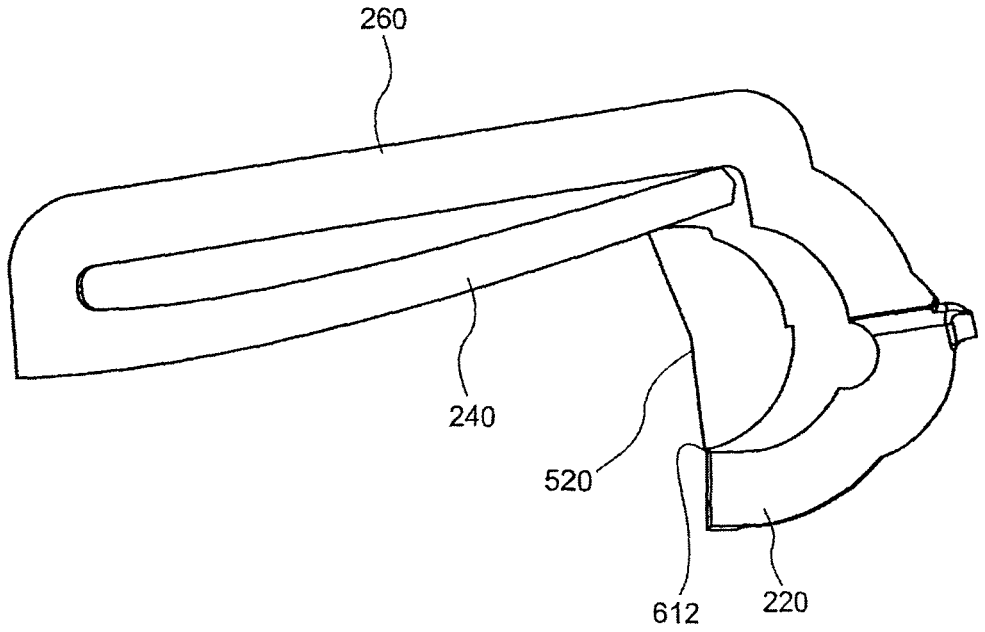
FIGS. 5A and 5B are views for explaining a state in which a bearing is separated from a shaft portion in the one embodiment of the present disclosure.
Figure 5B:
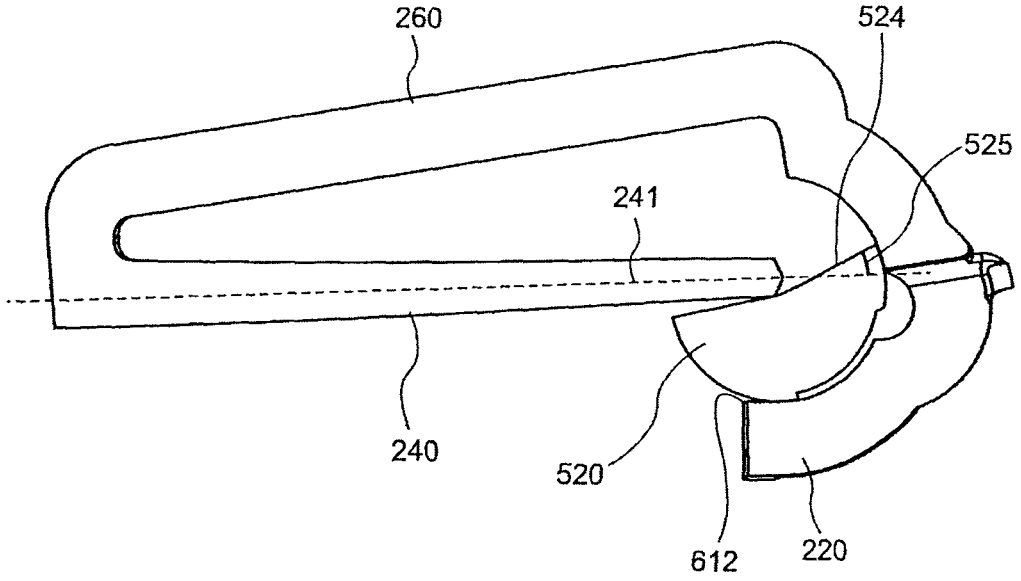

FIGS. 5A and 5B are views for explaining a state in which the bearing is separated from the shaft portion in the one embodiment of the present disclosure. The following two methods are examples of a method of separating the bearing 220 from the shaft portion 520. In the present embodiment, since the shaft portion 520 is fixed to the frame 500, when the bearing 220 is inclined with respect to the shaft portion 520, the bearing 220 is separated from the shaft portion 520. The following description however uses drawings in which the orientation of the bearing 220 is fixed, and the shaft portion 520 is inclined with respect to the bearing 220.

The separating method illustrated in FIG. 5A is a method of separating the bearing 220 from the shaft portion 520 by upward bending of the supporter 240 due to an external force. In this case, the supporter 240 is bent upward by the external force, and thereby the width between the supporter 240 and the open end 612 becomes greater than the diameter of the shaft portion 520, so that the bearing 220 is separated from the shaft portion 520. When the width between the supporter 240 and the open end 612 becomes greater than or equal to the largest diameter of the shaft portion 520, the bearing 220 is separated from the shaft portion 520 independently of a pivotal positional relationship between the shaft portion 520 and the hammer assembly 200.

The separating method illustrated in FIG. 5B is a method of separating the bearing 220 from the shaft portion 520 even without no external force applied to the supporter 240, when the pivotal positional relationship between the shaft portion 520 and the hammer assembly 200 has satisfied a particular condition. The state illustrated in FIG. 5B is a state in which the lower stopper 410 is removed in FIG. 3, and the weight 230 has pivoted downward greatly. In this case, the bearing 220 is separated from the shaft portion 520 only by moving the hammer assembly 200 in the direction in which the bearing 220 is separated from the shaft portion 520. In some shapes of the bearing 220 and the supporter 240, in the case where an angle 525 of a cutout surface 524 of the shaft portion 520 with respect to a longitudinal direction 241 of the supporter 240 is less than 90 degrees, when the bearing 220 is moved in the direction in which the bearing 220 is separated from the shaft portion 520, the cutout surface 524 moves the supporter 240 toward the body 260. Accordingly, the bearing 220 can be separated from the shaft portion 520 without an external force for moving the supporter 240 toward the body 260. It is noted that the above-described angle is an angle in a state in which the cutout surface 524 faces toward the body 260.

As described above, when the relationship between the shaft portion 520 and the bearing 220 has satisfied the particular condition, the pivot mechanism 900 of the hammer assembly 200 is disassembled. Conversely, the pivot mechanism 900 is not disassembled in a normal operation range of the pivot mechanism 900. In the pivot mechanism 900, the supporter 240 is bent in a direction tangent to the contact surface of the shaft portion 520 at the contact between the supporter 240 and the contact surface of the shaft portion 520. This differs from a common snap-fit.

In the pivot mechanism 900 according to the first embodiment, as described above, it is easy to mount the shaft portion 520 on the bearing 220, and it is difficult for the bearing 220 to be separated from the shaft portion 520.

Operations of Keyboard Assembly

Figure 6A:
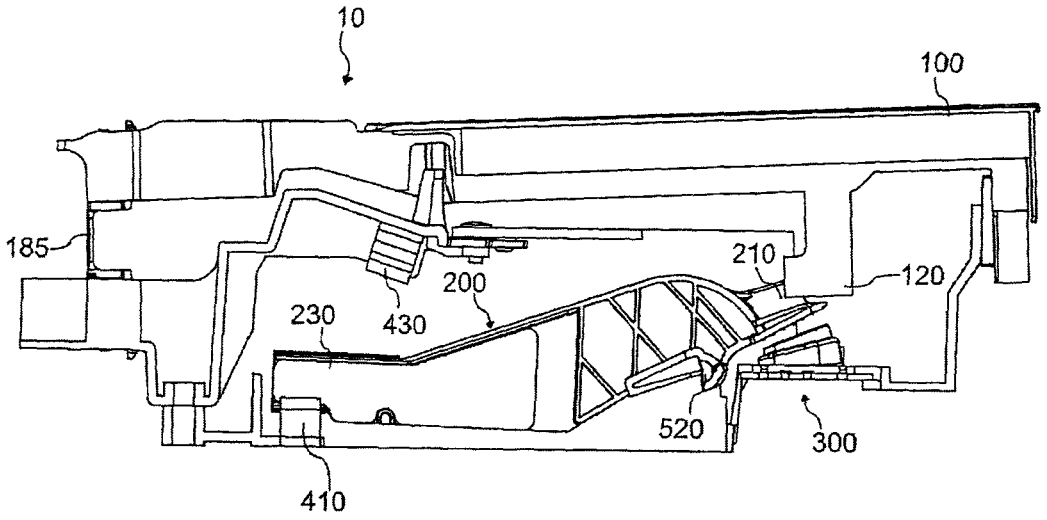
FIGS. 6A and 6B are views for explaining operations of a keyboard assembly when a key (a white key) is depressed in the one embodiment of the present disclosure.
Figure 6B:
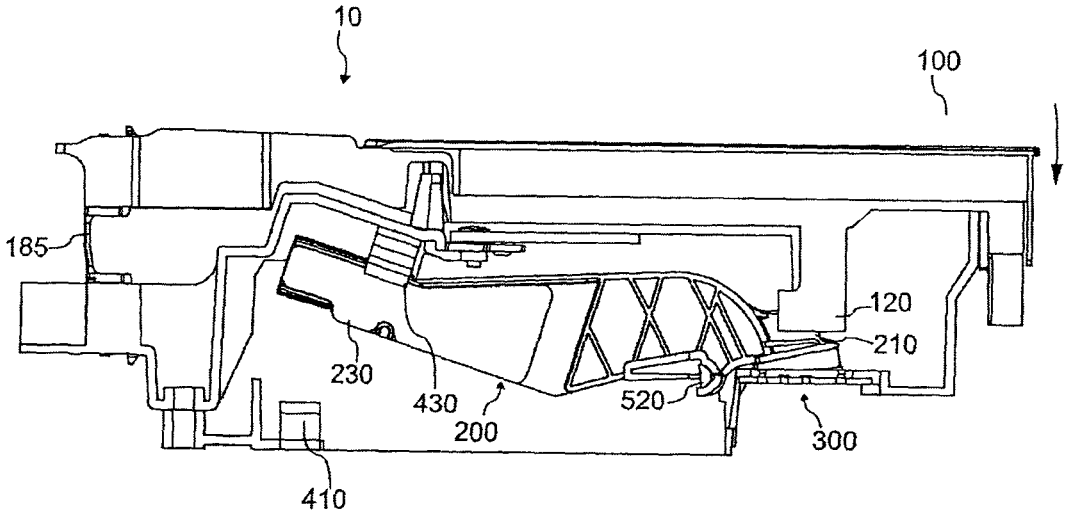

FIGS. 6A and 6B are views for explaining operations of the key assembly when the key (the white key) is depressed in the one embodiment of the present disclosure. FIG. 6A is a view illustrating a state in which the key 100 is located at a rest position (that is, the key is not depressed). FIG. 6B is a view illustrating a state in which the key 100 is located at an end position (that is, the key is fully depressed). When the key 100 is pressed, the rod-like flexible member 1850 is bent as a pivot center. In this state, though the rod-like flexible member 185 is bent toward the front side of the key (in the front direction), the side-surface key guide 153 inhibits the key 100 from moving in the front and rear direction, and thereby the key 100 pivots instead of moving frontward. The hammer supporter 120 depresses the front end portion 210, causing pivotal movement of the hammer assembly 200 about the shaft portion 520. When the weight 230 collides with the upper stopper 430, the pivotal movement of the hammer assembly 200 is stopped, and the key 100 reaches the end position. When the sensor 300 is deformed by the front end portion 210, the sensor 300 outputs the detection signals in accordance with a plurality of levels of an amount of deformation of the sensor 300 (i.e., the key pressing amount).

When the key is released, the weight 230 moves downward, the hammer assembly 200 pivots, and the key 100 pivots upward. When the weight 230 comes into contact with the lower stopper 410, the pivotal movement of the hammer assembly 200 is stopped, and the key 100 is returned to the rest position. In the keyboard apparatus 1 according to the first embodiment, as described above, the key 100 pivots at the connecting portion 180 in response to key pressing and key releasing.

Second Embodiment

Figure 7A:
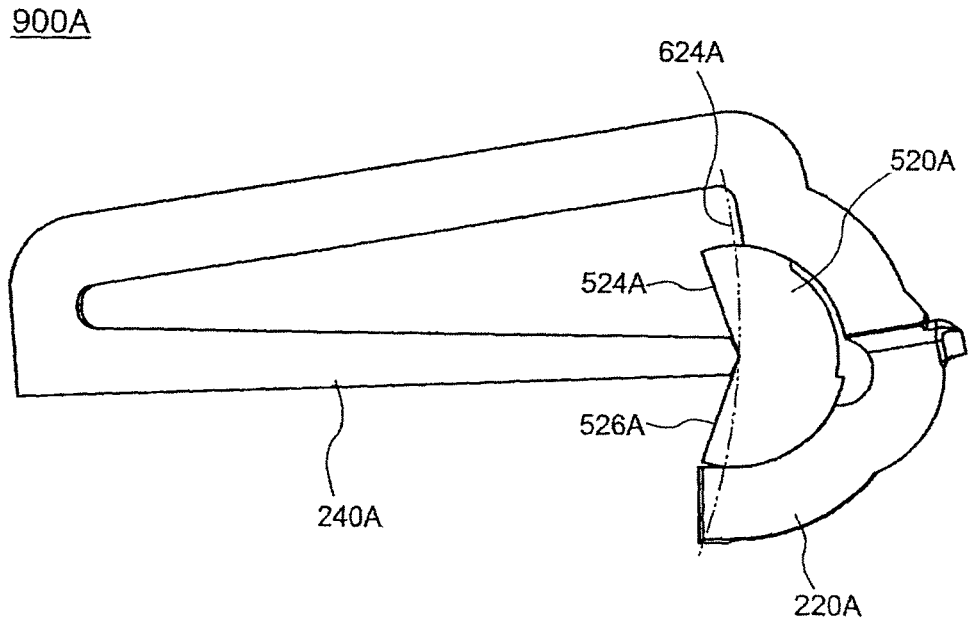
FIGS. 7A and 7B are enlarged views of a portion of the pivot mechanism of the hammer assembly according to one embodiment of the present disclosure.
Figure 7B:
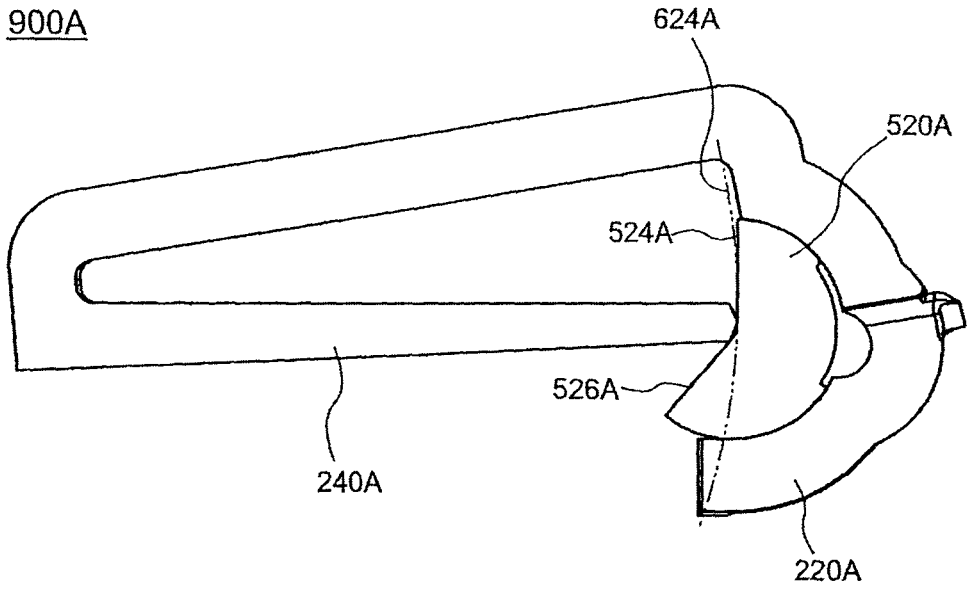

There will be described a pivot mechanism 900A according to a second embodiment which is different in configuration from the pivot mechanism 900 according to the first embodiment. FIGS. 7A and 7B are enlarged views of a portion of a hammer assembly in one embodiment of the present disclosure. The shape of a shaft portion 520A in the pivot mechanism 900A according to the second embodiment is different from that of the shaft portion 520 in the first embodiment.

FIG. 7A illustrates a state of the pivot mechanism 900A when a bearing 220A for the shaft portion 520A is located in a first region of a movable range of the bearing 220A. The first region is a region in which the bearing 220A pivots with respect to the shaft portion 520A when the key 100 is moved in an operation range extending from the rest position to the end position (a range of use of the keyboard assembly) in a keyboard assembly 10A including the pivot mechanism 900A. That is, one end portion of the first region is a pivotal position of the bearing 220A with respect to the shaft portion 520A when the key 100 is located at the rest position, and the other end portion of the first region is a pivotal position of the bearing 220A with respect to the shaft portion 520A when the key 100 is located at the end position. In the first region, the cutout surfaces 524A, 526A of the shaft portion 520A are inclined toward a supporter 240A. In other words, each of the cutout surfaces 524A, 526A is located nearer to the supporter 240A than an imaginary path 624A of a distal end of the supporter 240A. The imaginary path 624A is a path of movement of the distal end of the supporter 240A during bending of the supporter 240A. The supporter 240A pivots such that its distal end moves along the imaginary path 624A. In the state illustrated in FIG. 7A, each of the cutout surfaces 524A, 526A is located nearer to the supporter 240A than the imaginary path 624A. In other words, the imaginary path 624A overlaps a part of the shaft portion 520A. In the above-described configuration, the supporter 240A is engaged with the cutout surface 524A or 526A, so that the range of the pivotal movement of the supporter 240A is limited.

FIG. 7B illustrates a state of the pivot mechanism 900A when the bearing 220A for the shaft portion 520A is located in a second region of the movable range. The second region includes a state in which the pivot mechanism 900A is disassemblable. That is, the second region is different from the first region in which the key 100 corresponds to the operation range extending from the rest position to the end position. When the bearing 220A is located in the second region, the cutout surface 524A is farther from the supporter 240A than the imaginary path 624A (nearer to the bearing 220A than the imaginary path 624A). In other words, the imaginary path 624A overlaps a portion of the shaft portion 520A near the cutout surface 526A but does not overlap a portion of the shaft portion 520A near the cutout surface 524A. The supporter 240A is bent upward by an external force in this state, whereby the shaft portion 520A is separated from the bearing 220A. The state illustrated in FIG. 7B is a state of an end portion of the movable range of the bearing 220A with respect to the shaft portion 520A. The second region may include a position of the bearing 220A when the key 100 is located at the rest position, or a position of the bearing 220A when the key 100 is located at the end position. That is, the second region may include one end portion of the first region.

In the pivot mechanism 900A according to the second embodiment, as described above, it is difficult for the bearing 220 to be separated from the shaft portion 520A particularly in the range of the pivotal movement of the pivot mechanism 900A which corresponds to the range of use of the keyboard assembly.

Third Embodiment

Figure 8:
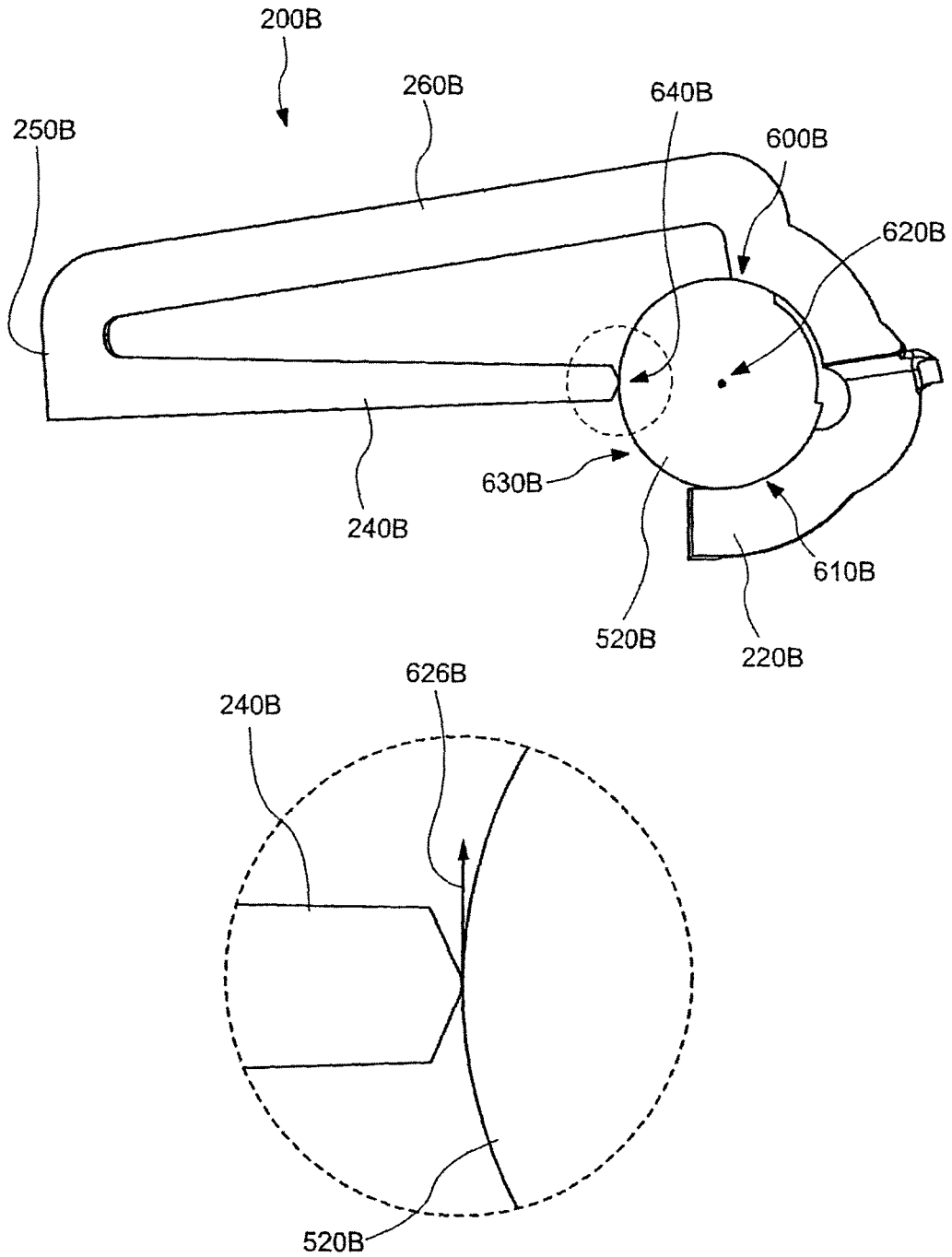
FIG. 8 is an enlarged view of a portion of the pivot mechanism of the hammer assembly according to one embodiment of the present disclosure.

There will be described a pivot mechanism 900B according to a third embodiment which is different in configuration from the pivot mechanism 900 according to the first embodiment. FIG. 8 is an enlarged view of a portion of a hammer assembly in one embodiment of the present disclosure. The shape of a shaft portion 520B in the pivot mechanism 900B according to the third embodiment is different from that of the shaft portion 520 in the first embodiment.

The pivot mechanism 900B includes: the shaft portion 520B; a bearing 220B supported by the shaft portion 520B at a first contact 600B and a second contact 610B and configured to pivot about a pivot axis 620B; and a supporter 240B secured to the bearing 220B so as to contact the shaft portion 520B at a third contact 640B and configured to be bent in a direction different from a direction directed from the pivot axis 620B toward the third contact 640B. As described above, the pivot mechanism 900B is different from the pivot mechanism 900 in that the cross section of the shaft portion 520B has a generally round shape and that the third contact 640B between the supporter 240B and the shaft portion 520B is different from the pivot axis 620B in position.

Like the bearing 220 in FIG. 4, the bearing 220B is supported by the shaft portion 520B at the first contact 600B and the second contact 610B and configured to pivot about the pivot axis 620B. In the present example, the pivot axis 620B is located in the shaft portion 520B. The bearing 220B has an opening 630B. The shaft portion 520B is held in the opening 630B. It is noted that the first contact 600B and the second contact 610B are located on an inner circumferential surface of the bearing 220B in the opening 630B. The size of open ends 602B, 612B of the opening 630B (the distance between the open ends 602B, 612B) is greater than or equal to the largest diameter of the shaft portion 520B. The supporter 240B is bent in a direction 626B tangent to an outer circumferential surface of the shaft portion 520B at the third contact 640B or in a direction containing a component of the direction 626B. Here, each of an angle, centered at a point on the pivot axis 620B, between the first contact 600B and the second contact 610B, an angle, centered at a point on the pivot axis 620B, between the second contact 610B and the third contact 640B, and an angle, centered at a point on the pivot axis 620B, between the third contact 640B and the first contact 600B is less than 180 degrees.

The cross-sectional shape of each of the shaft portion 520B and the bearing 220B at the first contact 600B is an arc shape centered about a point on the pivot axis 620B. Likewise, the cross-sectional shape of each of the shaft portion 520B and the bearing 220B at the second contact 610B is an arc shape centered about a point on the pivot axis 620B. The cross-sectional shape of the shaft portion 520B at the third contact 640B (near the third contact 640B) is an arc shape centered about the pivot axis 620B. These shapes enable smooth pivotal movement of the bearing 220B with respect to the shaft portion 520B. It is noted that the cross-sectional shape of the distal end of the supporter 240B may be an arc shape centered about a point on the pivot axis 620B. In the case where the shaft portion 520B is in surface contact with the supporter 240B, any given point on the contact surface is the third contact 640B.

In the pivot mechanism 900B according to the third embodiment, as described above, the distance between the pivot axis 620B and the first contact 600B and the distance between the pivot axis 620B and the second contact 610B are equal to each other in a range of pivotal movement of the pivot mechanism 900B. This configuration results in a constant frictional force in pivotal movement of the pivot mechanism 900B.

Fourth Embodiment

Figure 9:
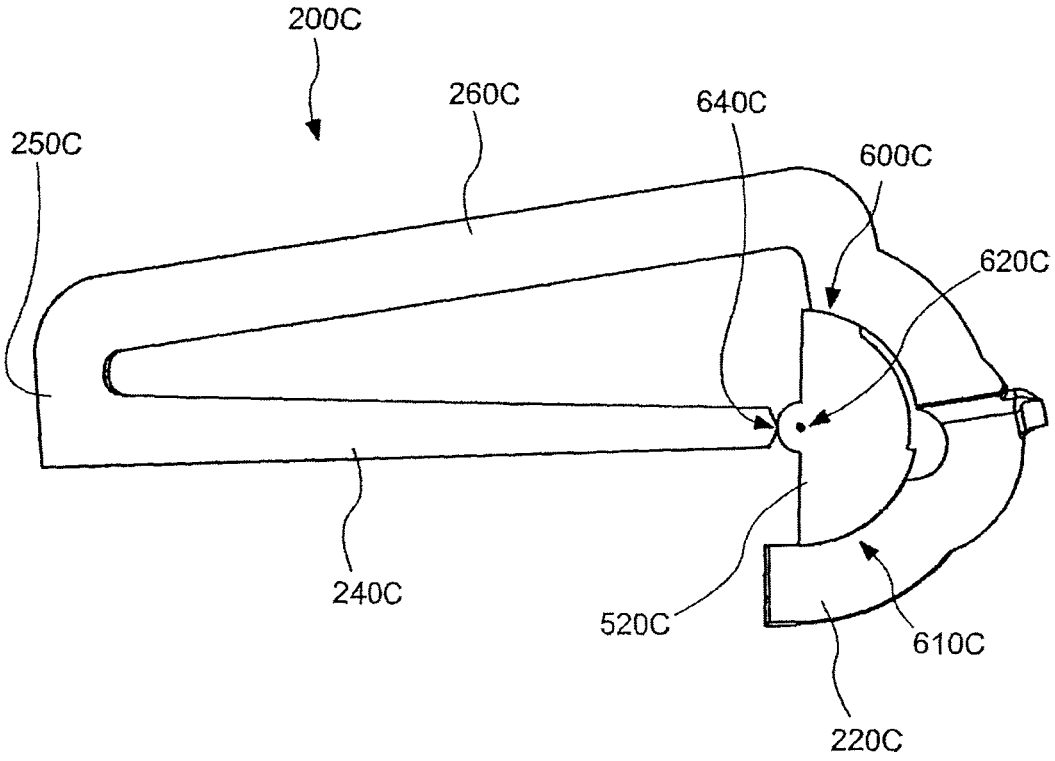
FIG. 9 is an enlarged view of a portion of the pivot mechanism of the hammer assembly according to one embodiment of the present disclosure.

There will be described a pivot mechanism 900C according to a fourth embodiment which is similar to the pivot mechanism 900B according to the third embodiment. FIG. 9 is an enlarged view of a portion of a hammer assembly in one embodiment of the present disclosure. The shape of a shaft portion 520C in the pivot mechanism 900C according to the fourth embodiment is different from that of the shaft portion 520B in the third embodiment.

The shaft portion 520C has a shape formed by coupling two circles having different curvature radiuses. In other words, the curvature radius of an arc of the shaft portion 520C at a third contact 640C is less than the curvature radius of an arc of the shaft portion 520C at each of a first contact 600C and a second contact 610C. Here, the curvature radius of the arc of the shaft portion 520C at the first contact 600C may be different from the curvature radius of the arc of the shaft portion 520C at the second contact 610C. In other words, the distance between a pivot axis 620C and the third contact 640C is less than each of the distance between the pivot axis 620C and the first contact 600C and the distance between the pivot axis 620C and the second contact 610C.

In the pivot mechanism 900C according to the fourth embodiment, as described above, it is possible to reduce an area in which a supporter 240C slides on the shaft portion 520C when a bearing 220C pivots with respect to the shaft portion 520C. This reduces a load on the supporter 240C in pivotal movement of the pivot mechanism 900C.

Fifth Embodiment

Figure 10:
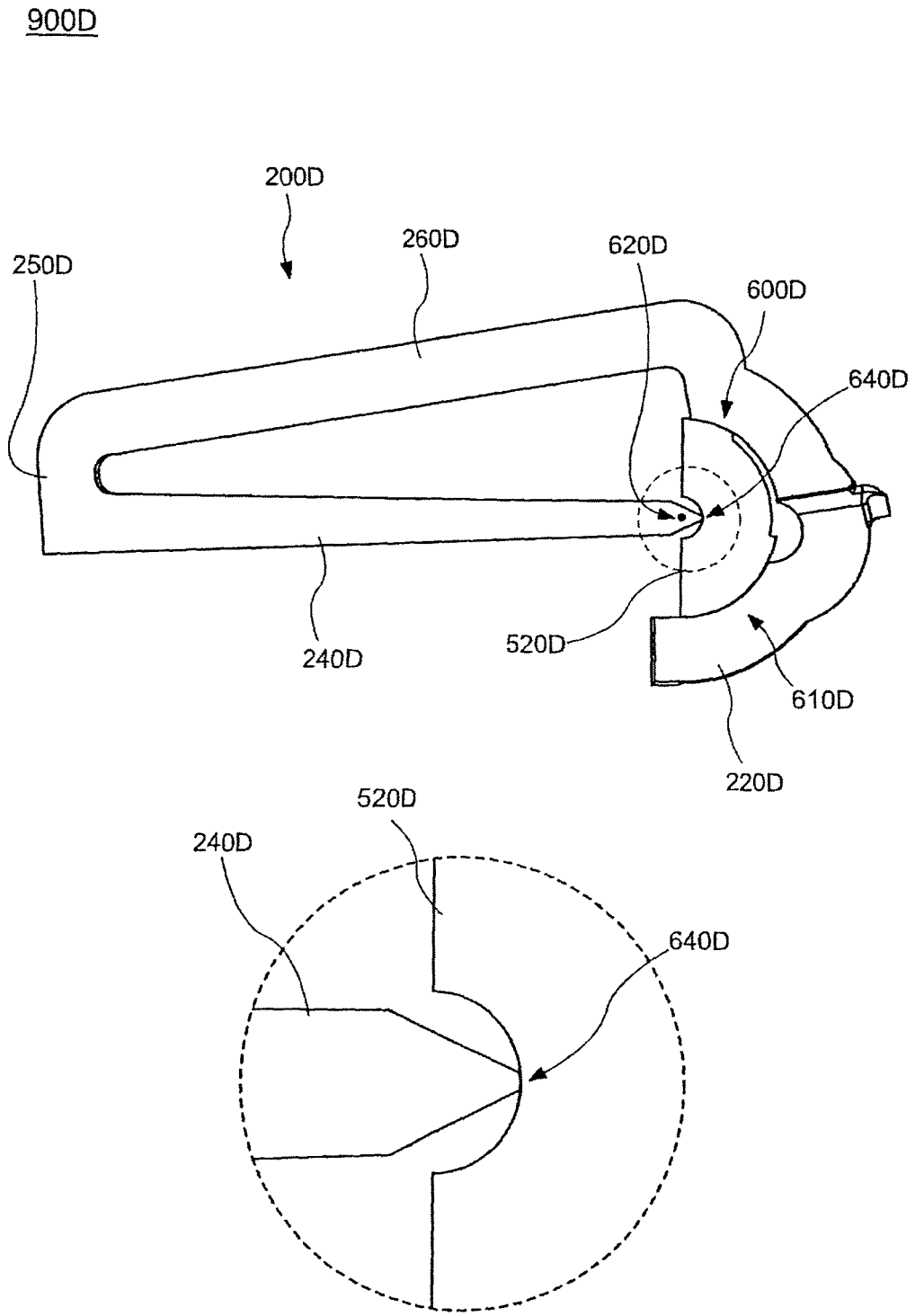
FIG. 10 is an enlarged view of a portion of the pivot mechanism of the hammer assembly according to one embodiment of the present disclosure.

There will be described a pivot mechanism 900D according to a fifth embodiment which is similar to the pivot mechanism 900C according to the fourth embodiment. FIG. 10 is an enlarged view of a portion of a hammer assembly in one embodiment of the present disclosure. The shape of a shaft portion 520D in the pivot mechanism 900D according to the fifth embodiment is different from that of the shaft portion 520C in the fourth embodiment.

The shaft portion 520D has a semicircular opening in a region including the center of the semicircular shape of the shaft portion 520D. The curvature radius of the semicircular opening is less than that of an outer circumference of the semicircular shape of the shaft portion 520D. Like the pivot mechanism 900C, a curvature radius of an arc of the shaft portion 520D is different at a first contact 600D and at a third contact 640D. Like the pivot mechanism 900A, a range of pivotal movement of a supporter 240D is limited by an inner surface of a bearing 220D in the opening of the shaft portion 520D. That is, a movable range of the bearing 220D with respect to the shaft portion 520D includes: a first region (a region including an operation range of the pivot mechanism 900D which corresponds to a range of use of the keyboard assembly); and a second region (a region including an end portion of the movable range of the bearing 220D with respect to the shaft portion 520D, i.e., a region different from the first region and including one end portion of the first region), and the supporter 240D is engaged with a part of the shaft portion 520D in the first region, and the supporter 240D is bendable in the second region until the shaft portion 520D is separable from the bearing 220D.

In the pivot mechanism 900D according to the fifth embodiment, as described above, it is possible to reduce a load on the supporter 240D in pivotal movement of the pivot mechanism 900D particularly in a range of the pivotal movement of the pivot mechanism 900A which corresponds to the range of use of the keyboard assembly, and it is difficult for the shaft portion 520D to be separated from the bearing 220D.

Sixth Embodiment

Figure 11:
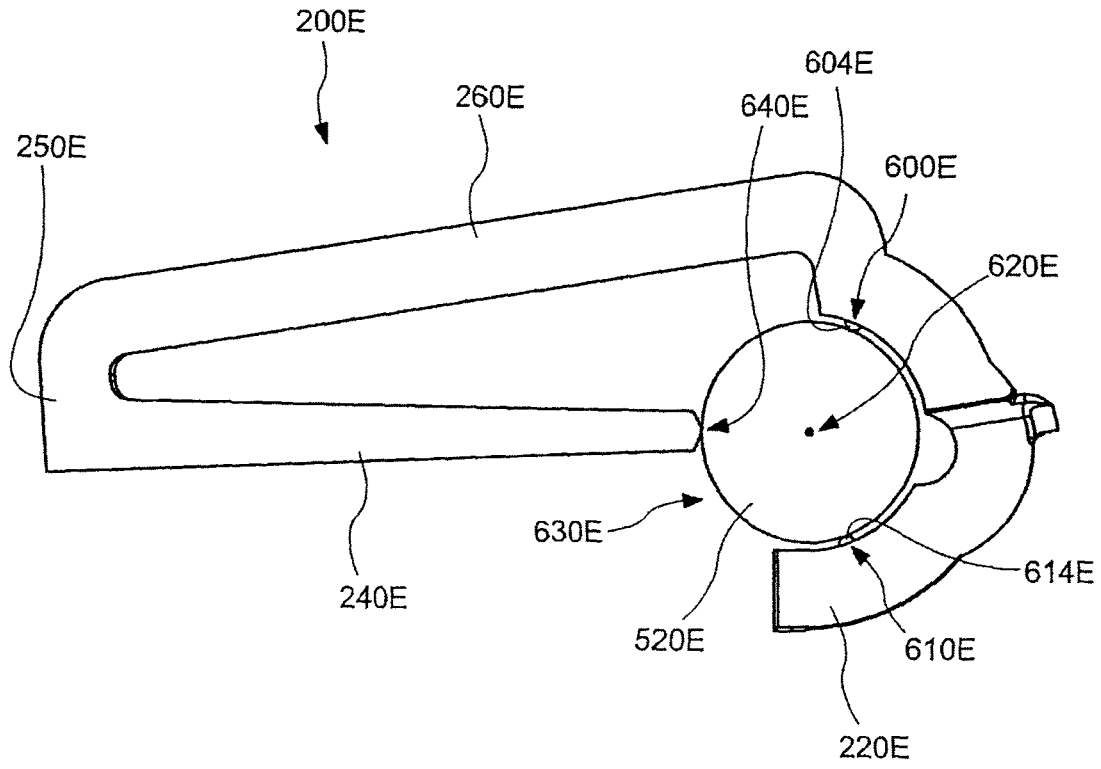
FIG. 11 is an enlarged view of a portion of the pivot mechanism of the hammer assembly according to one embodiment of the present disclosure.

There will be described a pivot mechanism 900E according to a sixth embodiment which is different in configuration from the pivot mechanism 900 according to the first embodiment. FIG. 11 is an enlarge view of a portion of a hammer assembly in one embodiment of the present disclosure. The shape of a bearing 220E in the pivot mechanism 900E according to the sixth embodiment is different from that of the bearing 220 in the first embodiment.

The bearing 220E has protrusions 604E, 614E each protruding in an opening 630E from an inner surface of the bearing 220E into the inside of the opening 630E. A shaft portion 520E contacts distal ends of the respective protrusions 604E, 614E. That is, each of the distal ends of the respective protrusions 604E is a first contact 600E, and each of the distal ends of the respective protrusions 614E is a second contact 610E. The protrusions 604E are provided in an extending direction of the shaft portion 520E, and the protrusions 614E are provided in the extending direction of the shaft portion 520E. It is noted that each of the protrusions 604E, 614E may have a line shape extending in the extending direction of the shaft portion 520E.

In the pivot mechanism 900E according to the sixth embodiment, as described above, it is possible to reduce an area in which each of the protrusions 604E, 614E slides on the shaft portion 520E. This enables smooth pivotal movement of the pivot mechanism 900E.

Seventh Embodiment

Figure 12:
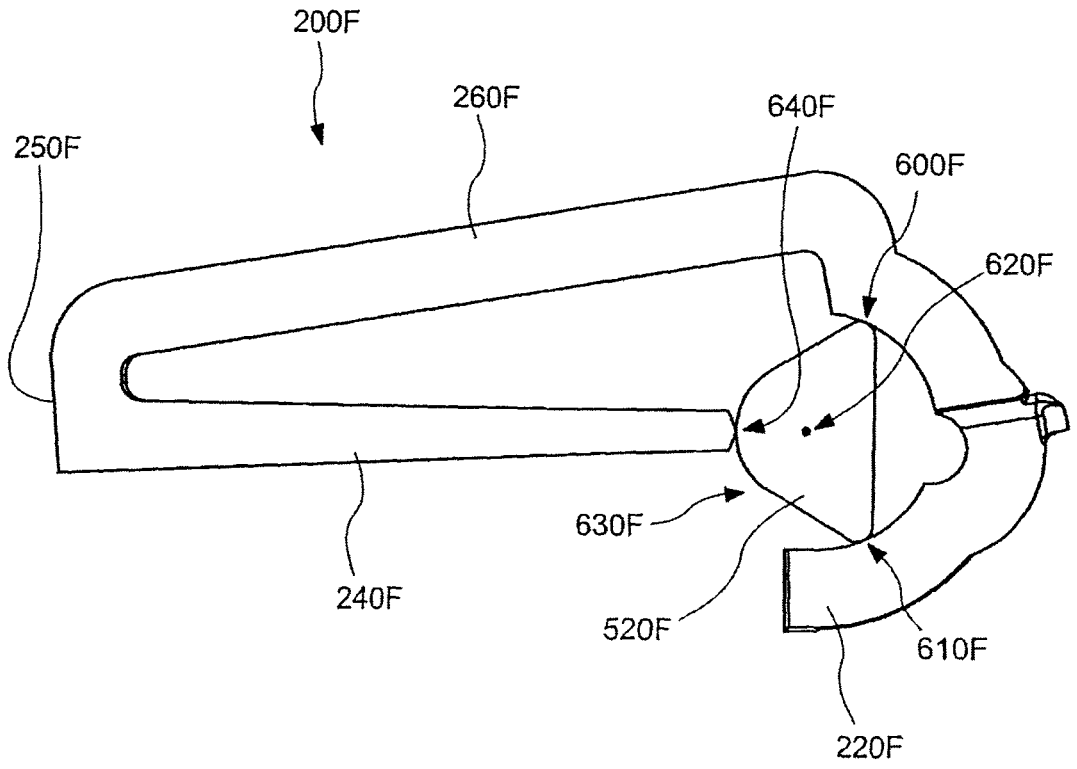
FIG. 12 is an enlarged view of a portion of the pivot mechanism of the hammer assembly according to one embodiment of the present disclosure.

There will be described a pivot mechanism 900F according to a seventh embodiment which is different in configuration from the pivot mechanism 900 according to the first embodiment. FIG. 12 is an enlarged view of a portion of a hammer assembly in one embodiment of the present disclosure. The shape of a shaft portion 520F in the pivot mechanism 900F according to the seventh embodiment is different from that of the shaft portion 520 in the first embodiment.

The shaft portion 520F has a shape in which a curvature radius of the shaft portion 520F at each of a first contact 600F and a second contact 610F is less than a curvature radius of an inner surface of a bearing 220F in an opening 630F of the bearing 220F. This shape reduces an area in which the bearing 220F is slid on the shaft portion 520F. The shape of the shaft portion 520F at each of the first contact 600F and the second contact 610F may be an arc shape centered about a pivot axis 620F. It is noted that the cross-sectional shape of the shaft portion 520F at a third contact 640F is an arc shape centered about a point on the pivot axis 620F. Thus, the shape of the shaft portion 520F need not be a round shape, and a shaft portion of any shape may be used.

Eighth Embodiment

Figure 13:
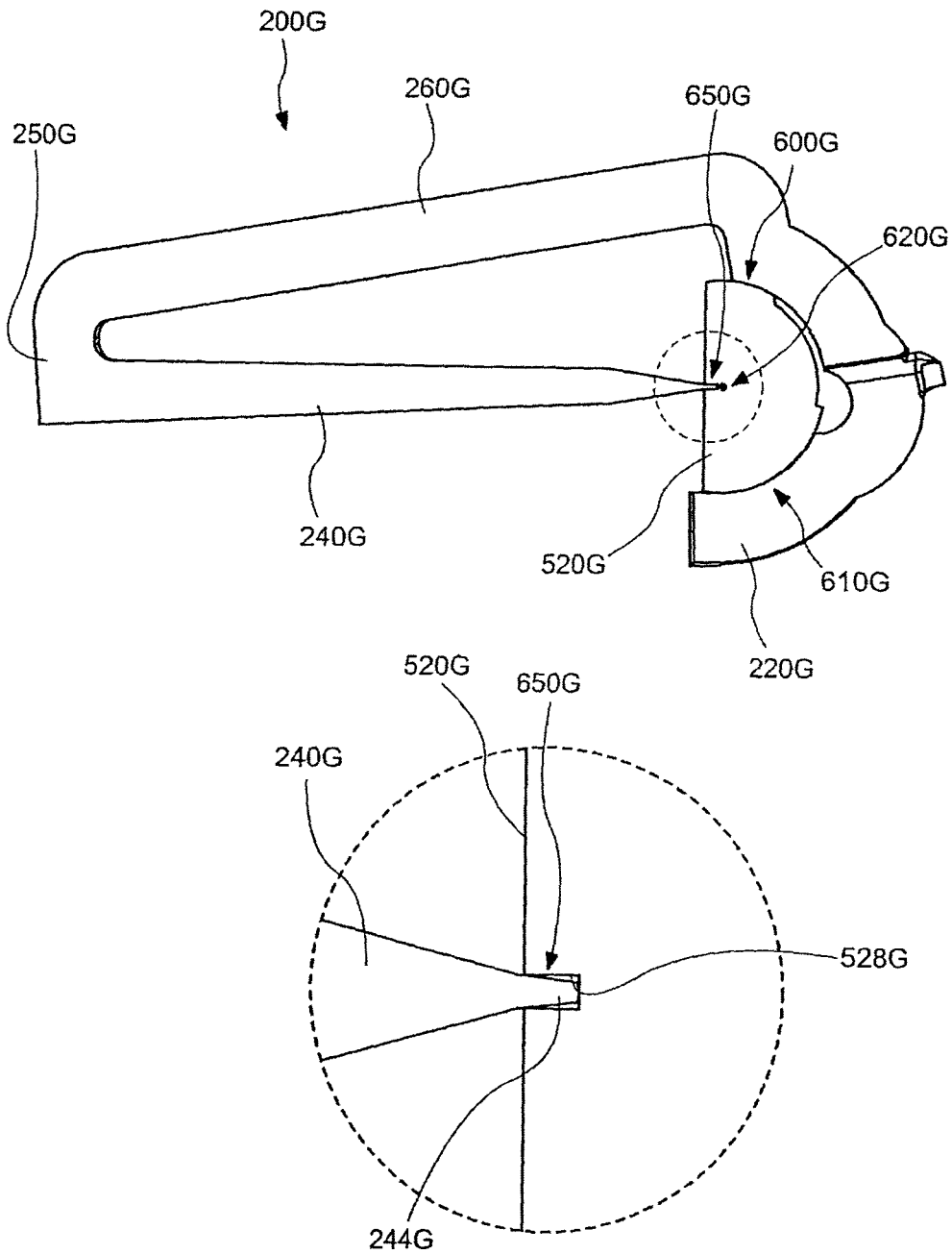
FIG. 13 is an enlarged view of a portion of the pivot mechanism of the hammer assembly according to one embodiment of the present disclosure.
Figure 14:
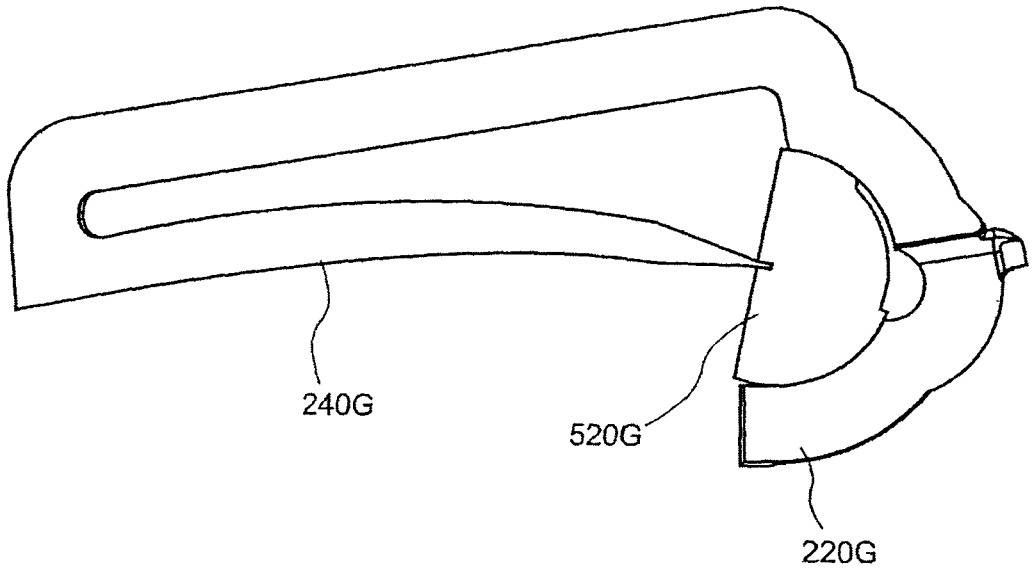
FIG. 14 is a view for explaining operations of the pivot mechanism of the hammer assembly according to the one embodiment of the present disclosure.
Figure 14:
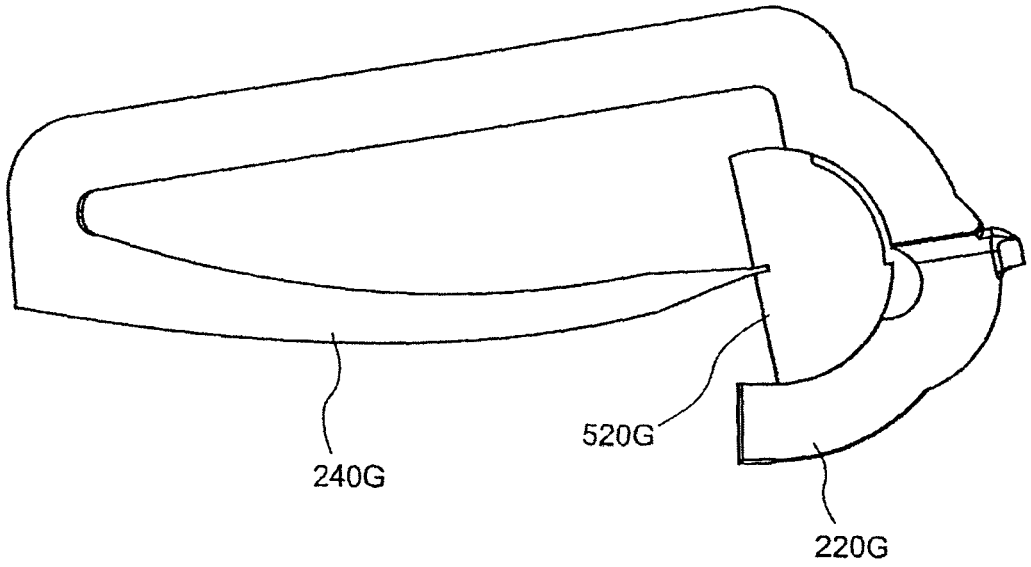

There will be described a pivot mechanism 900G according to an eighth embodiment which is different in configuration from the pivot mechanism 900 according to the first embodiment. FIG. 13 is an enlarged view of a portion of a hammer assembly in one embodiment of the present disclosure. FIG. 14 is a view for explaining operations of the hammer assembly in the one embodiment of the present disclosure. The shapes of a shaft portion 520G and a supporter 240G in the pivot mechanism 900G according to the eighth embodiment are different respectively from the shapes of the shaft portion 520 and the supporter 240 in the first embodiment.

The shaft portion 520G has a recess 528G at a position near the supporter 240G. The supporter 240G has a pointed portion 244G at a distal end of the supporter 240G. The pointed portion 244G is fitted in the recess 528G at a connecting portion 650G to connect the supporter 240G to the shaft portion 520G. The connecting portion 650G corresponds to the third contact in the other embodiments. Unlike the pivot mechanisms according to the other embodiments, the supporter 240G is not slid on the shaft portion 520G in the pivot mechanism 900G. As illustrated in FIG. 14, the supporter 240G is bent in accordance with an angle of pivotal movement of the shaft portion 520G with respect to a bearing 220G. It is noted that the supporter 240G preferably has enough flexibility because of the need of buckling of the supporter 240G when the bearing 220G is mounted on the shaft portion 520G. As another mounting method, the bearing 220G may be disposed at a predetermined position, and the shaft portion 520G may be inserted in the depth direction of FIG. 13 such that the pointed portion 244G is fitted into the recess 528G. Adhesive may be provided between the pointed portion 244G and the recess 528G, for example, to secure the shaft portion 520G and the supporter 240G to each other. In the case where the shaft portion 520G and the supporter 240G are secured to each other, the shaft portion 520G and a portion of the supporter 240G may be formed as a unit. For example, the shape illustrated in FIG. 13 may be formed by: forming a portion of the supporter 240G near the connecting portion 250G in a shape in which the portion is split in two in a longitudinal direction of the supporter 240G; forming a portion of the supporter 240G near the shaft portion 520G integrally with the shaft portion 520G; and bonding the supporter 240G when the bearing 220G is mounted.

In the pivot mechanism 900G according to the eighth embodiment, as described above, the distal end of the supporter 240G is not slid by pivotal movement of the pivot mechanism 900G, resulting in a reduced wearing out of the distal end of the supporter 240G.

Ninth Embodiment

Figure 15:
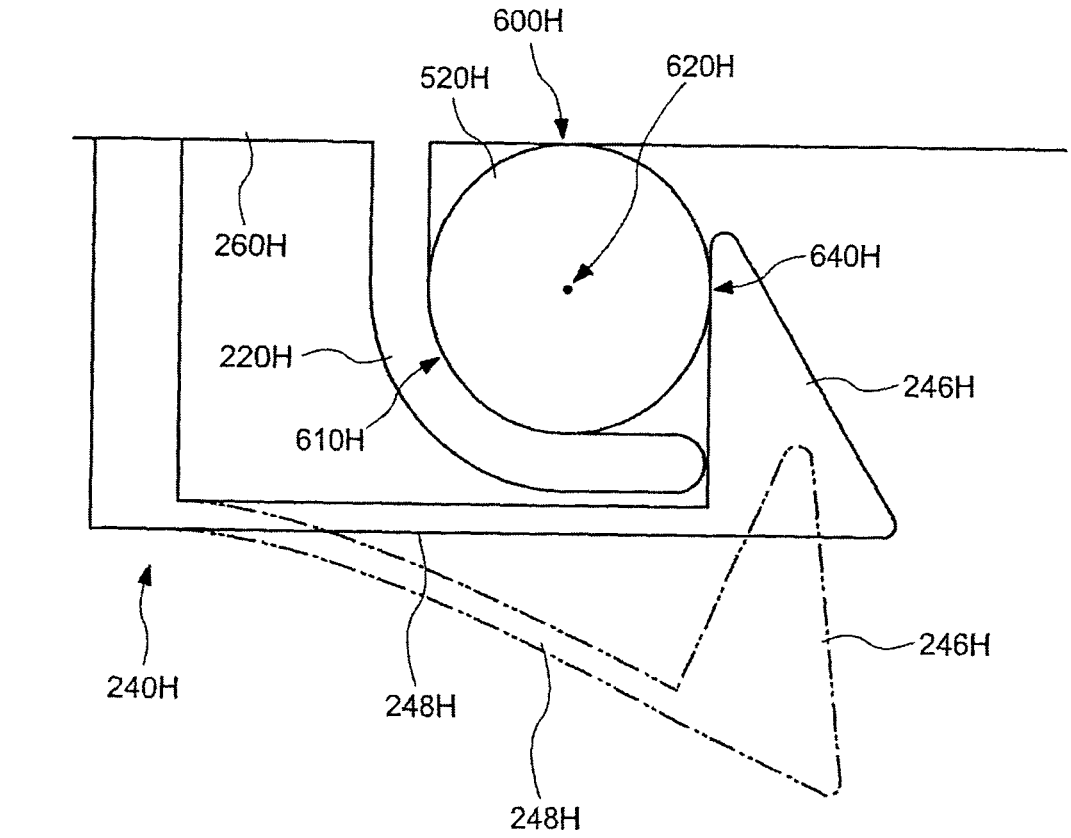
FIG. 15 is an enlarged view of a portion of the pivot mechanism of the hammer assembly according to one embodiment of the present disclosure.

There will be described a pivot mechanism 900H according to a ninth embodiment which is different in configuration from the pivot mechanism 900 according to the first embodiment. FIG. 15 is an enlarged view of a portion of a hammer assembly in one embodiment of the present disclosure. The pivot mechanism 900H includes a bearing 220H, a supporter 240H, and a body 260H. Each of the bearing 220H and the supporter 240H extend downward from the body 260H. The supporter 240H includes a flexible arm 248H and a head 246H coupled to a distal end of the arm 248H. A shaft portion 520H contacts the body 260H at a first contact 600H, contacts the bearing 220H at a second contact 610H, and contacts the head 246H at a third contact 640H. It is noted that when the arm 248H is bent by depression of the head 246H as indicated by the two-dot chain lines, the bearing 220H is separated from the shaft portion 520H.

Tenth Embodiment

Figure 16A:
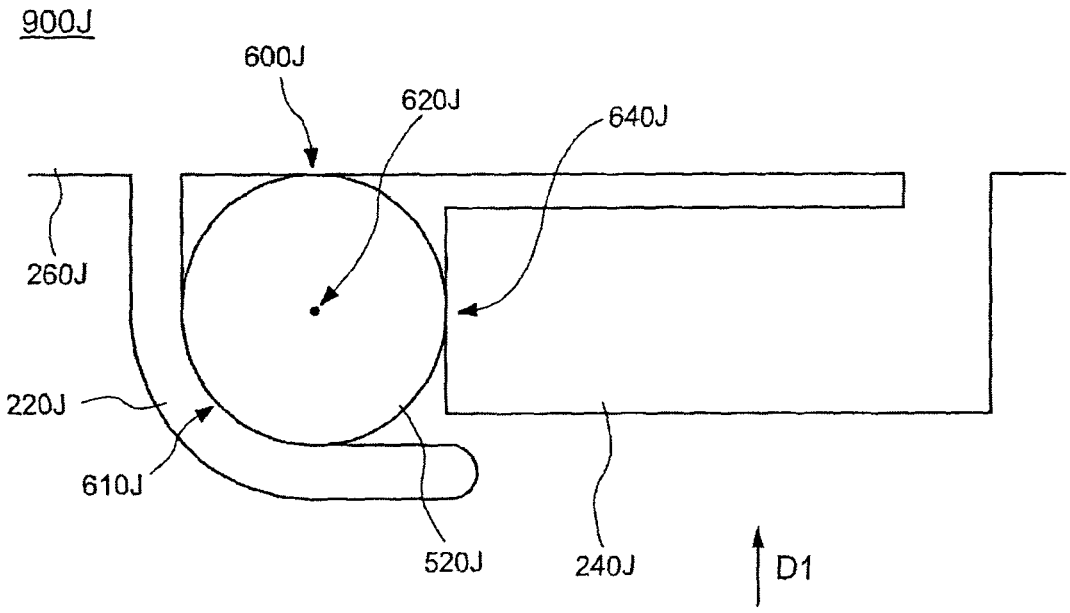
FIGS. 16A and 16B are enlarged views of a portion of the pivot mechanism of the hammer assembly according to one embodiment of the present disclosure.
Figure 16B:
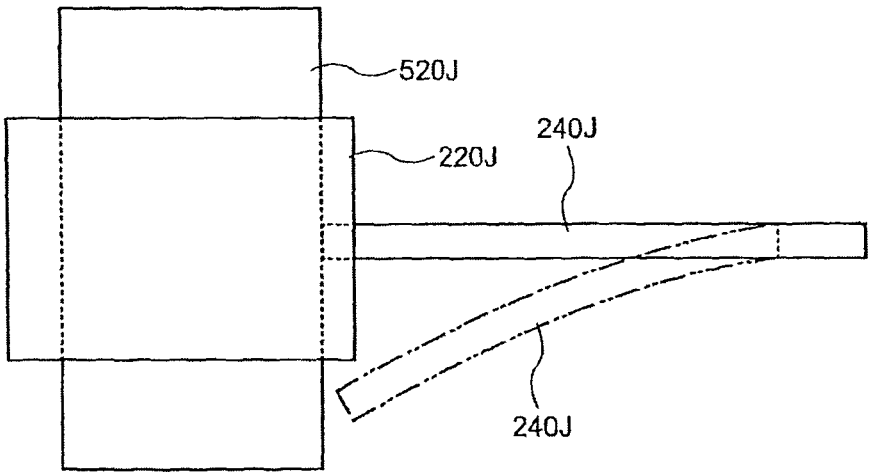

There will be described a pivot mechanism 900J according to a tenth embodiment which is different in configuration from the pivot mechanism 900 according to the first embodiment. FIGS. 16A and 16B are enlarged views of a portion of a hammer assembly in one embodiment of the present disclosure. The pivot mechanism 900J includes a bearing 220J, a supporter 240J, and a body 260J. FIG. 16A is a side view of a hammer assembly 200J. FIG. 16B is a view of a lower surface of the hammer assembly 200J when viewed in the direction indicated by D1.

Each of the bearing 220J and the supporter 240J extends downward from the body 260J. The supporter 240J is shaped like a thin plate extending in an extending direction of a shaft portion 520J and is bent in the extending direction (see FIG. 16B). The shaft portion 520J contacts the body 260J at a first contact 600J, contacts the bearing 220J at a second contact 610J, contacts the supporter 240J at a third contact 640J. It is noted that, as indicated by the two-dot chain lines in FIG. 16B, the bearing 220J is separated from the shaft portion 520J by bending the supporter 240J in the extending direction of the shaft portion 520J.

In the pivot mechanism 900H according to the ninth embodiment and the pivot mechanism 900J according to the tenth embodiment, as described above, it is easy to mount the bearings 220H, 220J respectively on the shaft portions 520H, 520J, and it is difficult for the bearings 220H, 220J to be separated respectively from the shaft portions 520H, 520J.

In the above-described embodiments, the electronic piano is taken as one example of the keyboard apparatus to which the hammer assembly is applied. The hammer assemblies according to the above-described embodiments may be applied to a pivot mechanism of acoustic pianos (e.g., a ground piano and an upright piano). For example, the pivot mechanisms in the above-described embodiments may be applied to a pivot mechanism of an upright piano which includes a pivot component and a supporter configured to support the pivot component pivotably. In this case, a sound producing mechanism corresponds to a hammer and a string.

The pivot mechanisms according to the above-described embodiments may be applied to pivot components in instruments other than the piano.

It is to be understood that the present disclosure is not limited to the illustrated embodiments, but may be embodied with various changes and modifications, without departing from the spirit and scope of the disclosure.

What is claimed is:

1. A pivot mechanism providing for an attachment between a stationary part and a pivotable part, the pivot mechanism comprising:

a shaft with a shaft length portion and ends, at least one of the ends being secured to one of the stationary part and the pivotable part;

a shaft length portion receiver secured to the other of the stationary part and the pivotable part and comprising a c-shaped member, made of a flexing material, defining an opening in which the shaft is to be inserted, the shaft length portion receiver being configured to contact the shaft at a first contact and a second contact and configured to pivot about a pivot axis relative to the shaft;

an arm secured to either an end or an intermediate part of the c-shaped member and extending away from the opening, the arm comprising an elbow at one end of the arm; and a blocker arm, made of a flexing material, extending from the elbow to face the opening of the shaft length portion receiver and having a blocking position when the blocker arm is not flexed and a non-blocking position when flexed, the blocker arm being configured to contact the shaft at a third contact, and bendable in a direction different from a direction from the pivot axis toward the third contact, wherein a distance between the pivot axis and the third contact is less than each of a distance between the pivot axis and the first contact and a distance between the pivot axis and the second contact.

2. The pivot mechanism according to claim 1, wherein each of an angle, centered about the pivot axis, between the first contact and the second contact, an angle, centered about the pivot axis, between the second contact and the third contact, and an angle, centered about the pivot axis, between the third contact and the first contact is less than 180 degrees.

3. The pivot mechanism according to claim 1, wherein each of the first contact and the second contact is located on an inner surface of the shaft length portion receiver in the opening, and wherein a size of the opening at an open end of the shaft length portion receiver is greater than or equal to a largest diameter of the shaft.

4. The pivot mechanism according to claim 1, wherein a movable range of the shaft length portion receiver with respect to the shaft comprises a first region and a second region comprising an end portion of the first region, wherein the blocker arm is engaged with a portion of the shaft when the shaft length portion receiver is located in the first region, and wherein, when the shaft length portion receiver is located in the second region, the blocker arm is not engaged with the shaft and is bendable until the shaft length portion receiver becomes separable from the shaft.

5. The pivot mechanism according to claim 1, wherein the blocker arm is bendable in a direction tangent to a cross section of a contact surface of the shaft at the third contact that is a position at which the blocker arm and the contact surface of the shaft contact each other.

6. The pivot mechanism according to claim 1, wherein each of a cross-sectional shape of the shaft or the shaft length portion receiver at the first contact and a cross-sectional shape of the shaft or the shaft length portion receiver at the second contact is an arc shape centered about a point on the pivot axis.

7. The pivot mechanism according to claim 1, wherein each of a cross-sectional shape of the shaft or the shaft length portion receiver at the first contact and a cross-sectional shape of the shaft or the shaft length portion receiver at the second contact is an arc shape centered about a point on the pivot axis.

8. A pivot mechanism providing for an attachment between a stationary part and a pivotable part, the pivot mechanism comprising:

a shaft with a shaft length portion and ends, at least one of the ends being secured to one of the stationary part and the pivotable part;

a shaft length portion receiver secured to the other of the stationary part and the pivotable part and comprising a c-shaped member, made of a flexing material, defining an opening in which the shaft is to be inserted, the shaft length portion receiver being configured to contact the shaft at a first contact and a second contact and configured to pivot about a pivot axis relative to the shaft;

an arm secured to either an end or an intermediate part of the c-shaped member and extending away from the opening, the arm comprising an elbow at one end of the arm; and a blocker arm, made of a flexing material, extending from the elbow to face the opening of the shaft length portion receiver and having a blocking position when the blocker arm is not flexed and a non-blocking position when flexed, the blocker arm being configured to contact the shaft at a position on the pivot axis, and bendable in a direction away from at least one of the first contact and the second contact.

9. The pivot mechanism according to claim 8, wherein each of the first contact and the second contact is located on an inner surface of the shaft length portion receiver in the opening, and wherein a size of the opening at an open end of the shaft length portion receiver is greater than or equal to a largest diameter of the shaft.

10. The pivot mechanism according to claim 8, wherein the blocker arm is bendable in a direction different from a direction normal to an outer circumferential surface of the shaft at a contact that is a position at which the outer circumferential surface of the shaft and the blocker arm contact each other.

11. The pivot mechanism according to claim 8, wherein a movable range of the shaft length portion receiver with respect to the shaft comprises a first region and a second region comprising an end portion of the first region, wherein the blocker arm is engaged with a portion of the shaft when the shaft length portion receiver is located in the first region, and wherein, when the shaft length portion receiver is located in the second region, the blocker arm is not engaged with the shaft and is bendable until the shaft length portion receiver becomes separable from the shaft.

12. The pivot mechanism according to claim 8, wherein the blocker arm is configured to be bent in a direction tangent to a contact surface of the shaft at a contact between the contact surface of the shaft and the blocker arm.

13. A keyboard apparatus, comprising:

a key;

a hammer assembly configured to pivot, in response to pressing of the key, about a pivot mechanism providing for an attachment between a stationary part and a pivotable part, the pivot mechanism comprising (i) a shaft with a shaft length portion and ends, at least one of the ends being secured to one of the stationary part and the pivotable part, (ii) a shaft length portion receiver secured to the other of the stationary part and the pivotable part and comprising a c-shaped member, made of a flexing material, defining an opening in which the shaft is to be inserted, the shaft length portion receiver being configured to contact the shaft at a first contact and a second contact and configured to pivot about a pivot axis relative to the shaft, (iii) an arm secured to either an end or an intermediate part of the c-shaped member and extending away from the opening, the arm comprising an elbow at one end of the arm, and (iv) a blocker arm, made of a flexing material, extending from the elbow to face the opening of the shaft length portion receiver and having a blocking position when the blocker arm is not flexed and a non-blocking position when flexed, the blocker arm being configured to contact the shaft at a third contact, and bendable in a direction different from a direction from the pivot axis toward the third contact;

a sensor disposed below the key and configured to detect an operation of the key; and a sound source section configured to produce a sound waveform signal in response to an output signal of the sensor, wherein a distance between the pivot axis and the third contact is less than each of a distance between the pivot axis and the first contact and a distance between the pivot axis and the second contact.

14. A pivot mechanism providing for an attachment between a stationary part and a pivotable part, the pivot mechanism comprising:

a shaft with a shaft length portion and ends, at least one of the ends being secured to one of the stationary part and the pivotable part;

a shaft length portion receiver secured to the other of the stationary part and the pivotable part and comprising a c-shaped member, made of a flexing material, defining an opening in which the shaft is to be inserted, the shaft length portion receiver being configured to contact the shaft at a first contact and a second contact and configured to pivot about a pivot axis relative to the shaft;

an arm secured to either an end or an intermediate part of the c-shaped member and extending away from the opening, the arm comprising an elbow at one end of the arm; and a blocker arm, made of a flexing material, extending from the elbow to face the opening of the shaft length portion receiver and having a blocking position when the blocker arm is not flexed and a non-blocking position when flexed, the blocker arm being configured to contact the shaft at a third contact, and bendable in a direction different from a direction from the pivot axis toward the third contact, wherein the supporter is engaged with the shaft portion at the third contact and is bent with pivotal movement of the shaft portion.

* * * * *